US010060343B2

(12) United States Patent
Boutot et al.

(10) Patent No.: US 10,060,343 B2
(45) Date of Patent: Aug. 28, 2018

(54) AIR FLOW SYSTEM FOR AN ENCLOSED PORTABLE GENERATOR

(71) Applicant: Generac Power Systems, Inc., Waukesha, WI (US)

(72) Inventors: Jonathan R. Boutot, Waukesha, WI (US); Chad A. Adams, Pleasant Prairie, WI (US); Joel B. Soto, Maywood, IL (US)

(73) Assignee: Generac Power Systems, Inc., Waukesha, WI (US)

( * ) Notice: Subject to any disclaimer, the term of this patent is extended or adjusted under 35 U.S.C. 154(b) by 308 days.

(21) Appl. No.: 14/962,604

(22) Filed: Dec. 8, 2015

(65) Prior Publication Data

US 2016/0164375 A1 Jun. 9, 2016

Related U.S. Application Data

(60) Provisional application No. 62/089,582, filed on Dec. 9, 2014.

(51) Int. Cl.
*F01P 1/02* (2006.01)
*F02B 63/04* (2006.01)

(52) U.S. Cl.
CPC ..... *F02B 63/04* (2013.01)

(58) Field of Classification Search
CPC ... F02B 63/04; F02B 63/044; F02B 2063/045
USPC ..... 123/41.7
See application file for complete search history.

(56) References Cited

U.S. PATENT DOCUMENTS

| | | | | |
|---|---|---|---|---|
| 6,039,009 | A * | 3/2000 | Hirose | F02B 63/04 123/2 |
| 6,378,469 | B1 * | 4/2002 | Hiranuma | F02B 63/04 123/195 C |
| 6,917,121 | B2 | 7/2005 | Akimoto et al. | |
| 6,975,042 | B2 | 12/2005 | Yamada et al. | |
| 6,979,912 | B2 | 12/2005 | Mazuka et al. | |
| 7,291,932 | B2 | 11/2007 | Wurtele et al. | |
| 7,398,747 | B2 | 7/2008 | Onodera et al. | |
| 7,430,992 | B2 | 10/2008 | Murakami et al. | |
| 7,461,617 | B2 * | 12/2008 | Onodera | F01P 11/12 123/2 |
| 7,492,050 | B2 | 2/2009 | Brandenburg et al. | |
| 7,549,403 | B2 | 6/2009 | Yamamoto et al. | |
| 7,557,458 | B2 | 7/2009 | Yamamoto et al. | |
| 7,743,739 | B2 | 6/2010 | Kochi et al. | |
| 8,186,314 | B2 | 5/2012 | Brunelli et al. | |
| 8,544,425 | B2 | 10/2013 | Dorn et al. | |
| 2006/0065216 | A1 * | 3/2006 | Sugimoto | F01P 5/06 123/41.7 |
| 2007/0137591 | A1 * | 6/2007 | Sugimoto | F02B 43/00 123/41.7 |
| 2010/0037837 | A1 * | 2/2010 | Yamasaki | F01P 1/06 123/41.6 |

* cited by examiner

*Primary Examiner* — Hung Q Nguyen
(74) *Attorney, Agent, or Firm* — Boyle Fredrickson, S.C.

(57) ABSTRACT

An airflow system for an enclosed portable generator is provided that efficiently cools internal components by collecting an airflow and directing the entire airflow past a heat generating component such as an inverter module assembly before releasing the airflow in an unrestricted manner into an open interior space of the portable inverter generator. The airflow system includes an intake plenum system with a plenum body configured to collect and concentrate a volume of air as an intake airflow and to damp sound emission from a front side of housing of the generator.

18 Claims, 7 Drawing Sheets

AIR FLOW SYSTEM FOR AN ENCLOSED PORTABLE GENERATOR

CROSS-REFERENCE TO RELATED APPLICATION

The present application claims the benefit of U.S. Ser. No. 62/089,582 filed Dec. 9, 2014, which is incorporated by reference herein.

FIELD OF THE INVENTION

The present invention relates generally to portable inverter generators and, in particular, to an airflow system for an enclosed portable generator.

BACKGROUND AND SUMMARY OF THE INVENTION

Enclosed portable generators such as portable inverter generators are known and continue to gain popularity because of their relatively compact and lightweight configurations. Maintaining components of the portable inverter generators within acceptable operating temperatures can prove challenging. Such acceptable temperature maintenance challenges have been additionally complicated by recent efforts to make portable inverter generators even smaller and lighter within the same power output classes. Attempts have been made to address the acceptable temperature maintenance challenges by incorporating complex passages routed through the portable inverter generators to separately directed discrete airflows to different components. These tend to add to the overall cost and complexity of the portable inverter generators and their assembly.

Therefore, it is a primary object and feature of the present invention to provide an airflow system for an enclosed portable generator such as an inverter generator of a compact configuration that is cost effective.

It is a further object and feature of the present invention to provide an airflow system that reduces sound emission through a respective portion of the portable inverter generator.

The present invention is directed to an airflow system for an enclosed portable generator that efficiently cools components of the portable generator by collecting an airflow through a single opening and directing the entire airflow past a heat generating component such as an inverter module assembly before releasing the airflow in an unrestricted manner into an open interior space of the portable inverter generator. Other components of the portable generator use the air from the common open interior space for respective cooling. This allows for improved operation of components of the portable generator through efficient collection and direction of cooling air.

According to one aspect of the invention, an intake plenum system of an enclosed portable generator has a single intake plenum body that directs airflow into the generator. The intake plenum system is configured to collect intake air from outside of the enclosure and directs all of the collected air over the heat generating component such as an inverter module assembly or over cooling fins of an inverter heat sink. A bottom portion of the intake plenum body or an inverter module assembly duct collects air after cooling the inverter heat sink and directs flow into a common open interior space within the housing and toward secondary components such as an engine and alternator intake fan(s).

According to another aspect of the invention, the plenum body is configured to collect and direct an intake airflow across the inverter module assembly and is configured as an acoustic damping element preventing internal engine noise from line of sight egress. This reduces sound levels from the front of the generator by limiting sound egress with the plenum body presenting various spaced apart transversely stacked wall segments that present sound damping baffles toward a front wall of the housing.

According to another aspect of the invention, the airflow system is incorporated into an enclosed portable generator. The enclosed portable generator may be a portable inverter generator with a housing having interconnected walls defining an open interior space. The housing encloses an internal combustion engine driving an alternator operably connected to an inverter module assembly for producing AC (alternating current) power. The airflow system includes an intake plenum system directing an intake airflow into the enclosure for cooling the inverter module assembly. The intake plenum system, including a plenum body, has an intake end defining an intake opening corresponding to an intake plenum system point of entry. The point of entry at the plenum body intake opening receives air through a housing wall(s) as the intake airflow. An outlet end of the plenum body is arranged downstream of the intake end. The outlet end of the plenum body includes an outlet opening corresponding to an intake plenum system point of exit delivering the intake airflow out of the intake plenum system substantially unrestricted into the open interior space of the housing. Substantially all of the air in the open interior space of the housing may enter the open interior space of the housing through the intake plenum system.

According to another aspect of the invention, the plenum body intake opening may be misaligned with respect to the inverter module assembly. The plenum body intake opening may be arranged at the wall(s) of the housing at a position that is height staggered with respect to the inverter module assembly. The plenum body intake opening receives air through the front wall at a location that is arranged higher than a projected height of the inverter module assembly relative to the front wall and thus spaced farther from a bottom wall of the housing than the inverter module assembly. The plenum body and the inverter module assembly may be mounted to a common bracket extending vertically within the housing, for example, by way of weld studs defining locations of the plenum body and the inverter module assembly within the housing.

According to another aspect of the invention, the plenum body may include an inlet duct defining the intake end of the plenum body. The inlet duct extends from the plenum body intake opening toward the inverter module assembly. An inverter module assembly duct defines the outlet end of the plenum body and extends from the inlet duct toward the interior space the housing.

According to another aspect of the invention, the inlet duet and the inverter module assembly duct may be arranged at a non-perpendicular angle with respect to each other. At least a portion of the inlet duct may extend angularly with respect to the inverter module assembly. At least a portion of the inverter module assembly duct may extend parallel with respect to the inverter module assembly. The inverter module assembly duct may include a first wall segment arranged substantially parallel to a first surface of the inverter module assembly and a second wall segment arranged substantially parallel to a second surface of the inverter module assembly. The inverter module assembly may have a first side facing toward the open interior space of the housing and a second side facing away from the open interior space of the housing. The inverter module assembly duct may cover the second side of the inverter module assembly and include an outer wall segment transversely spaced from the second side of the inverter module assembly. This restricts flow of the intake airflow between the second side of the inverter module assembly and the outer wall segment of the inverter module assembly duct to flow longitudinally with respect to the second side of the inverter module assembly.

According to another aspect of the invention, the inverter module assembly duct includes side wall segments extending from the outer wall segment of the inverter module assembly duct toward and overlapping at least a portion of the inverter module assembly. The inverter module assembly may be at least partially nested within the inverter module assembly duct, with the inverter module assembly duct fitting in a cap-like manner over a forward facing surface of the inverter heat sink.

According to another aspect of the invention, the inlet duct is defined by multiple operably and releasably connected components. The inlet duct includes an inner wall segment connected to the inverter module assembly and an inlet duct outer wall segment connected to the housing front wall. Side wall segments of the inlet duct extend from the inner wall segment and collectively define a channel with a channel opening between the inlet duct side wall segments. The inlet duct outer wall segment is removably received between the inlet duct side wall segments, spanning across the channel opening to close the opening to form a closed perimeter wall arrangement of the inlet duct when the housing front wall is removably connected to the remainder of the housing. The housing front wall may have an outwardly facing surface and include a pocket recessed into the outwardly facing surface, extending inwardly toward the open interior space of the housing. At least a portion of the housing front wall pocket may define the inlet duct outer wall segment. The housing front wall pocket may include a pocket upper wall. The pocket upper wall may extend angularly from a perimeter extending about an opening of the housing front wall pocket facing away from the open interior space of the housing. The pocket upper wall may extend generally parallel to and spaced from the inlet duct inner wall segment. In this way, part of the inlet duct is defined by the front wall in conjunction with the respective portions of the plenum body, such as at the upper angled portion(s) of the plenum body.

According to another aspect of the invention, the inlet duct narrows from its inlet opening that initially receives the airflow from outside the enclosure to its outlet opening that releases the airflow into the inverter module assembly duct. This provides a scoop-like configuration of the inlet duct that can collect a relatively large volume of air and concentrate it into the airflow, which can increase the velocity of the airflow through the inverter module assembly duct in a venturi-like manner.

Other aspects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 1:
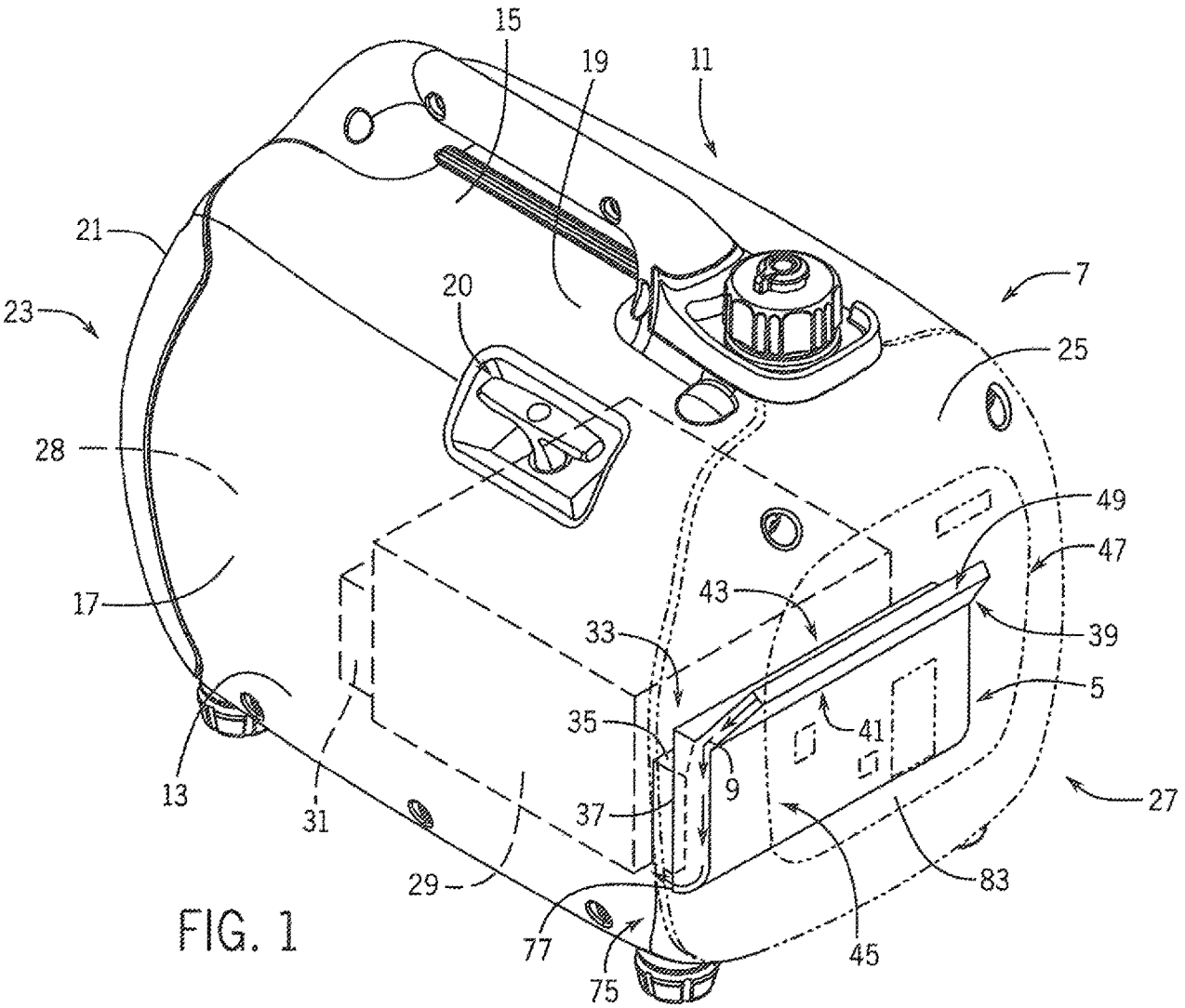
FIG. 1 is an isometric view of a simplified and partially schematic representation of an airflow system for an enclosed portable generator in accordance with the present invention.

Referring now to the drawings and specifically to FIG. 1, airflow system 5 for an enclosed portable generator shown as generator 7 is shown that is configured to collect and direct intake airflow 9 across various heat-generating components of generator 7 and provide acoustic damping of various sound-generating components of generator 7, as explained in greater detail elsewhere herein. Although generator 7 is shown an described as an enclosed portable inverter generator, it is understood that generator 7 comprehends other enclosed portable generators.

Still referring to FIG. 1, generator 7 includes housing 11 with interconnected panels or walls, including bottom and top walls 13, 15, and side walls 17, 19 extending between and connecting the top and bottom walls 13, 15. Recoil system 20 is arranged at an intersection between the upper portion of side wall 17 and a corresponding side portion of top wall 15. Recoil system 20 includes a recoil handle that is recessed into the intersection between top and side walls 15, 17 so that the recoil handle generally does not protrude beyond the outwardly facing surfaces of the housing 11, when at rest. By arranging the recoil handle of recoil system 20 at the intersection between top and side walls 15, 17, the recoil handle is presented at an ergonomic position facilitating grasping and a natural pulling motion by a user when starting generator 7. Housing 11 further includes back wall 21 arranged toward a back end 23 of the housing 11 and front panel or front wall 25 arranged toward a front end 27 of and removably attached to the remainder of housing 11.

Still referring to FIG. 1, the interconnected bottom, top, side, front, and back walls 13, 15, 17, 19, 21 and 25 collectively define an enclosure of housing 11 that surrounds an open interior space 28. Mounted within the space 28, internal combustion engine 29 drives an alternator 31 that produces multiphase AC (alternating current) power that is converted to DC (direct current) power. Inverter module assembly 33 converts the DC power into single phase AC power that replicates line power, such as 120V 60 Hz or other suitable voltages and frequencies of AC power, for powering various electrically powered products.

Still referring to FIG. 1, a heat generating component is arranged with respect to the airflow system 5 to be cooled by the airflow system 5. By way of example, the heat generating component is shown as inverter module assembly 33. Inverter module assembly 33 includes inverter module 35 that includes a controller that includes an industrial computer, microprocessor, or, e.g., a programmable logic controller (PLC), along with corresponding software and suitable memory for storing such software and hardware for controlling various electronic circuits or components of inverter module assembly 33 or generator 7. A database stored in a memory device may include additional configuration parameters for controlling the circuits of inverter module 35 to suitably produce and condition the power outputted by inverter module 35. Inverter module assembly 33 includes an inverter heat sink shown as heatsink 37 operably connected to inverter module 35 to absorb heat from inverter module 35 during use and release the absorbed heat to cool inverter module 35.

Figure 2:
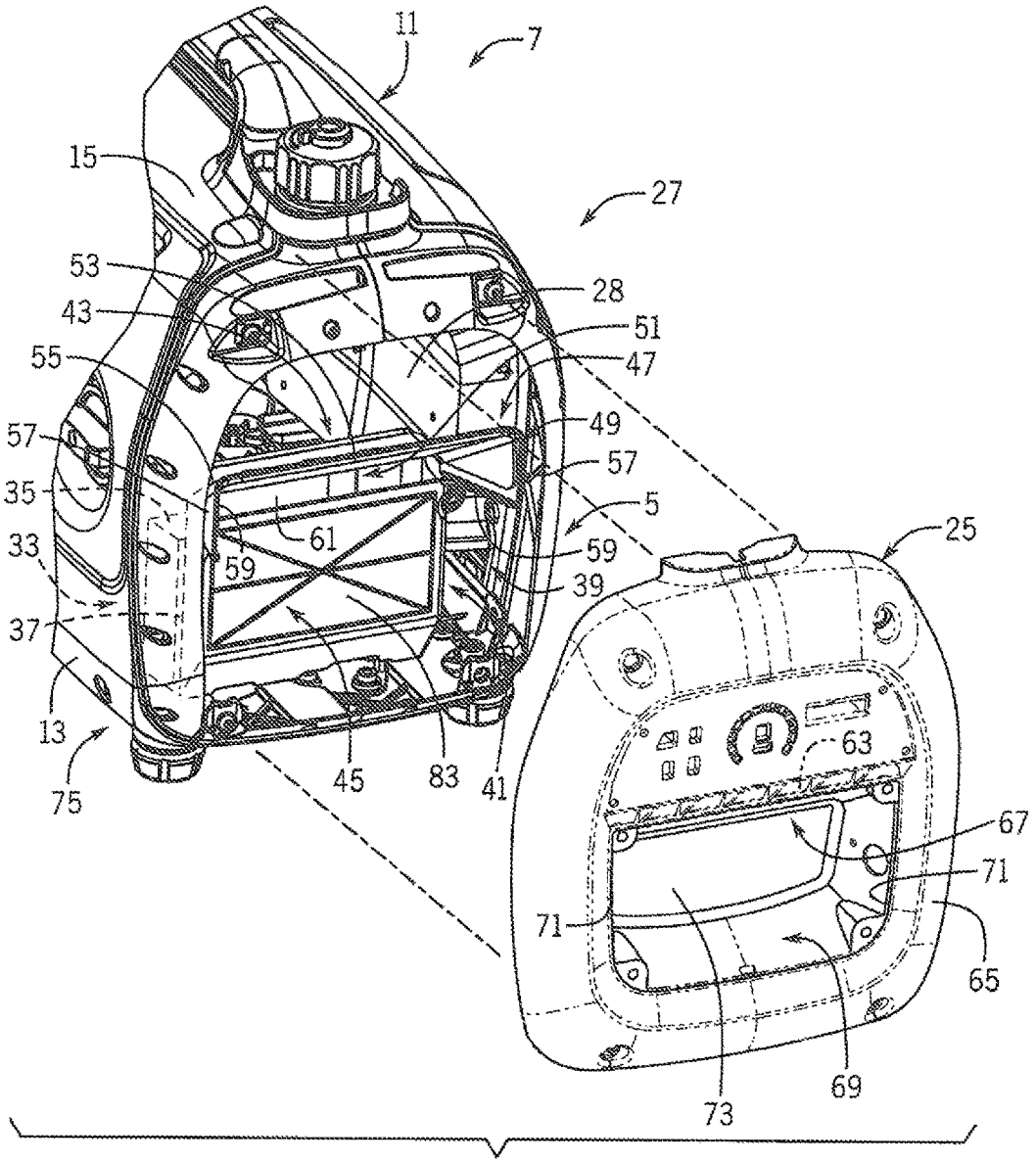
FIG. 2 is an isometric exploded view of a portion of an airflow system for a portable generator in accordance with the present invention.
Figure 3:
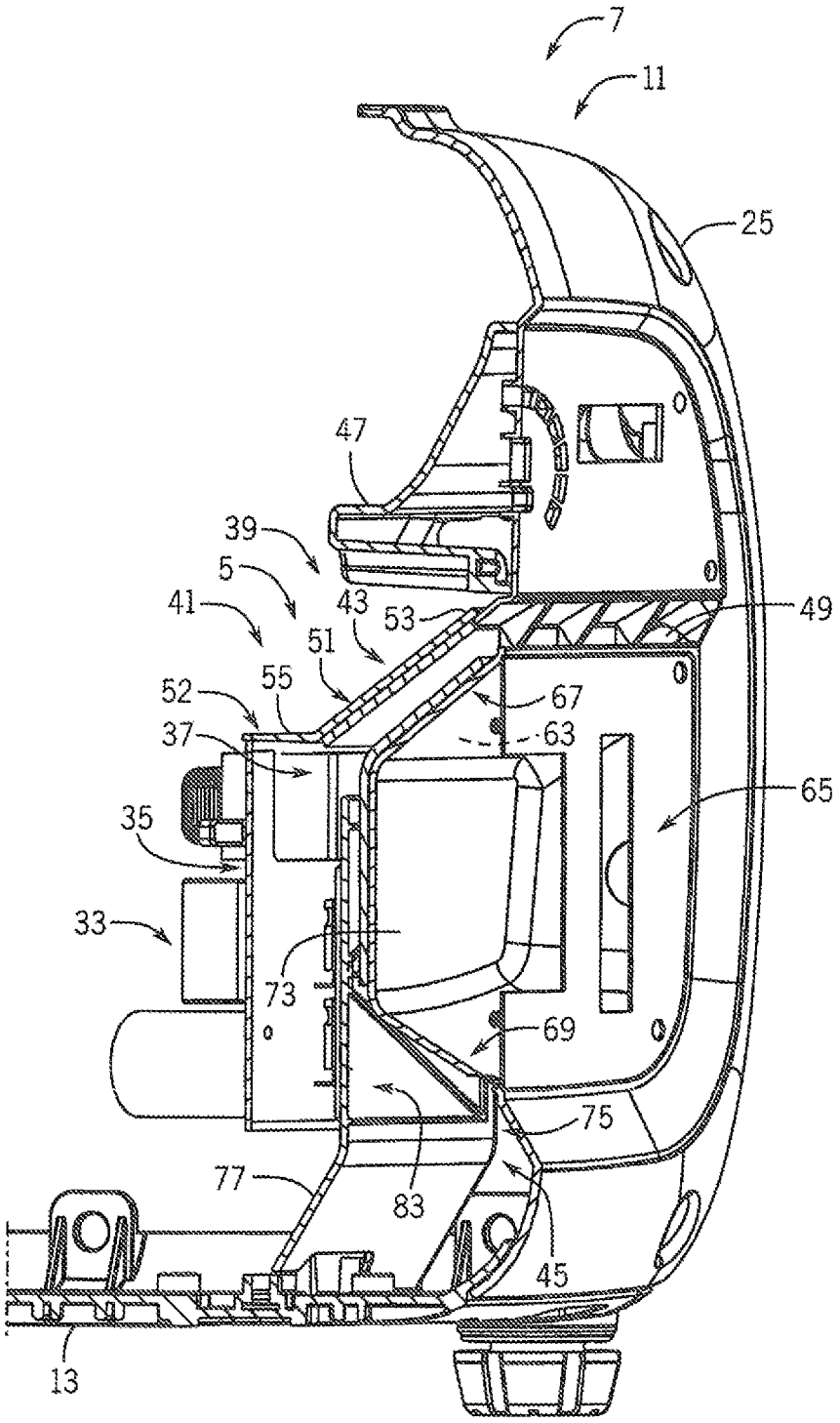
FIG. 3 is an isometric sectional view of a portion of an airflow system for a portable generator in accordance with the present invention.

Referring now to FIGS. 1-3, airflow system 5 includes intake plenum system 39 with plenum body 41 that has inlet duct 43 connected to inverter module assembly duct 45 configured to collect and direct intake airflow 9 (FIG. 1) across inverter module assembly 33 and reduce noise emitted through front wall 25. Inlet duct 43 is at a plenum body intake end 47 defining an intake opening 49 corresponding to an intake plenum system point of entry through the front wall 25, with inlet duct 43 extending angularly from plenum body intake opening 45 toward inverter module assembly 33.

Figure 4:
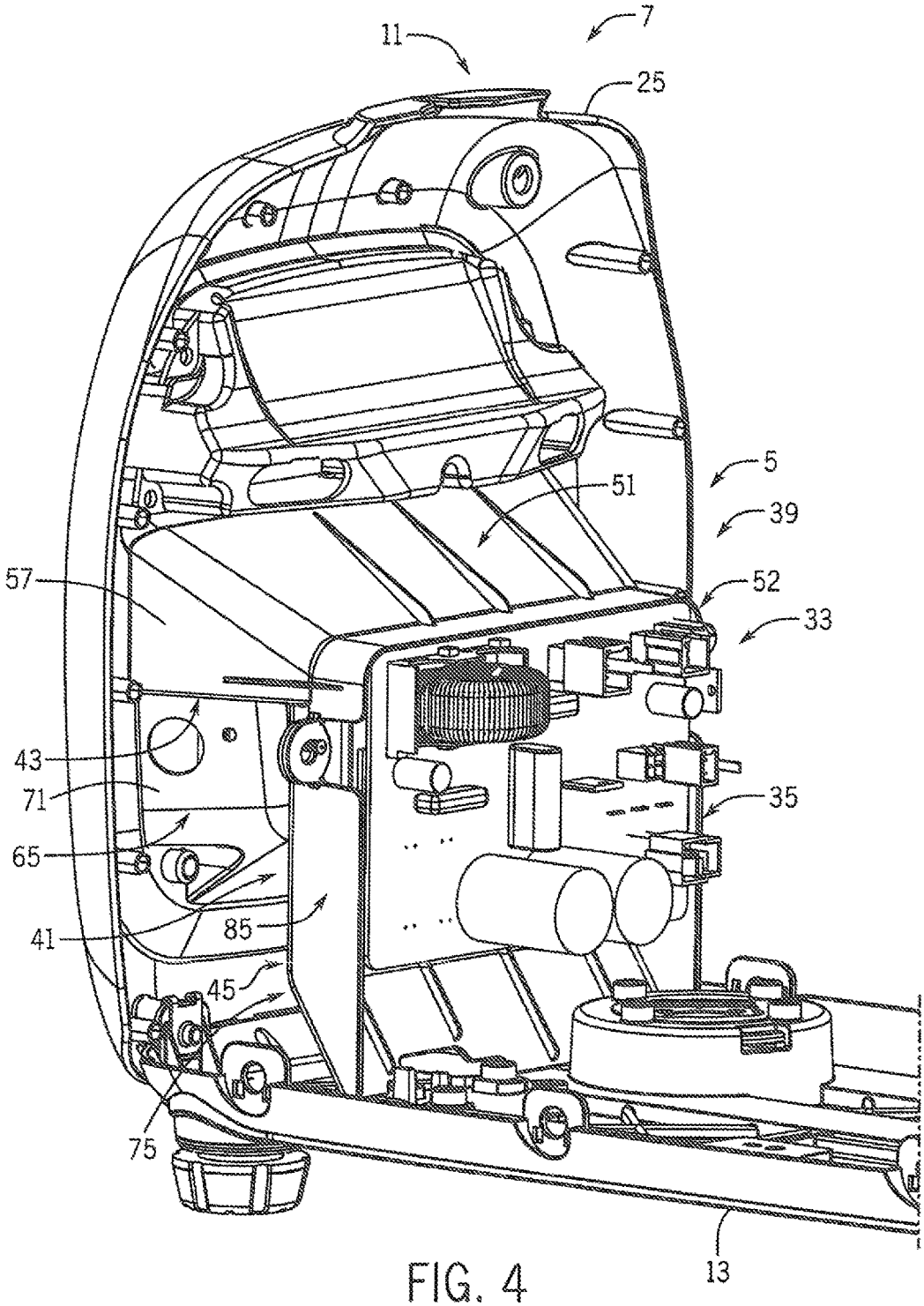
FIG. 4 is an isometric view of a portion of the airflow system of FIG. 3.
Figure 5:
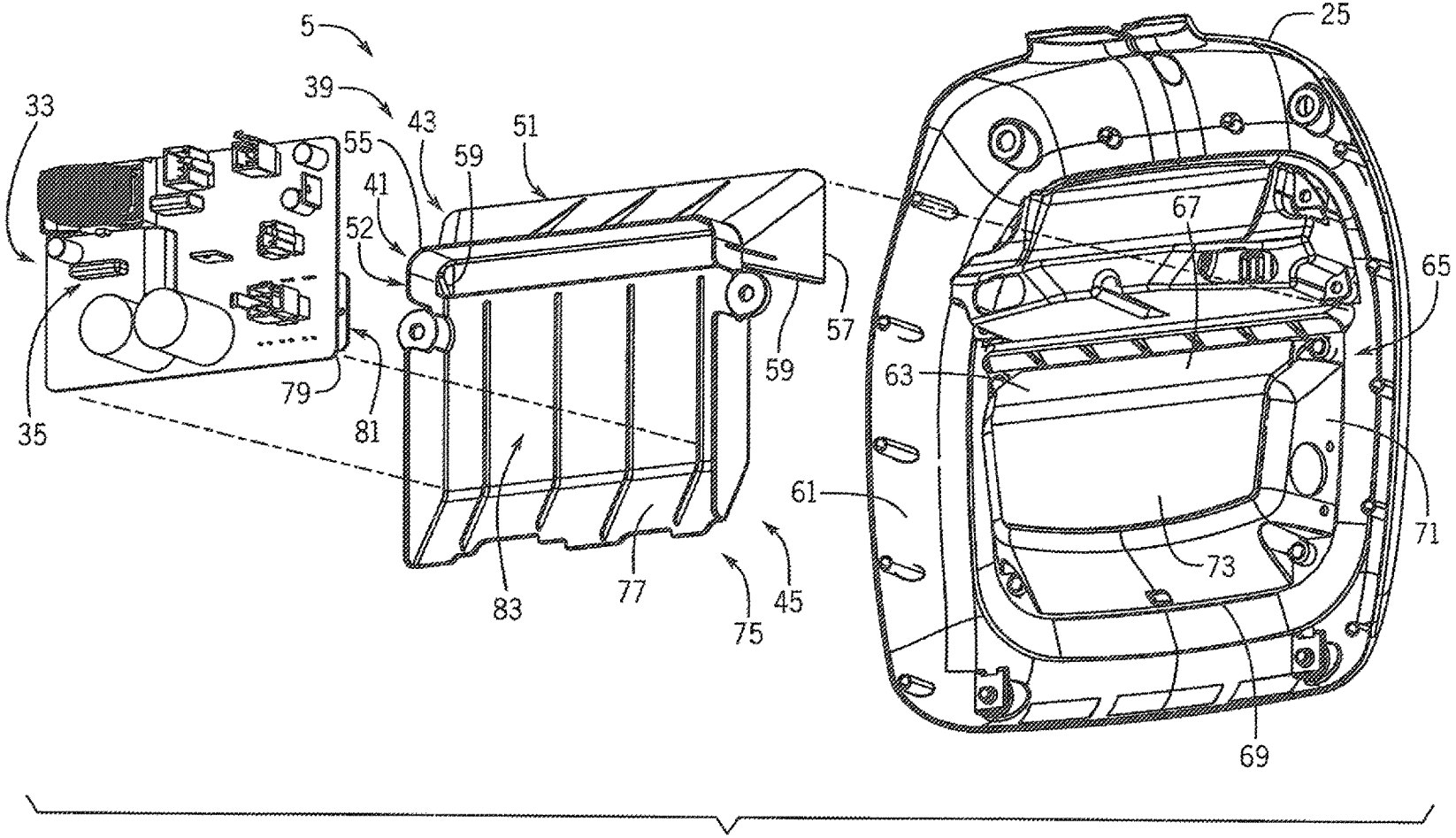
FIG. 5 is an isometric exploded view of a portion of the airflow system of FIG. 3.

Referring now to FIGS. 2 and 3, inlet duct 43 is shown having multiple operably and releasably connected components, such as various wall segments. Inlet duct 43 includes inner wall segment 51 with upper end 53 having an outer edge abutting front wall 25 of housing 11 and lower end 55 angularly intersecting upper end 53 extending generally parallel to lower wall 13. Lower end 55 of inner wall segment 51 defines a ledge or segment of a collar 52 attached to the inverter module assembly 33, shown as sealed against or engaging an upper wall of heatsink 37, with the other portions of the collar sealed against or engaging other portions of heatsink 37. Referring now to FIGS. 2, 4, and 5, side wall segments 57 of inlet duct 43 extend generally perpendicularly from outer portions of inlet duct inner wall segment 51 with ledges 59 extending from the lower portions of the side wall segments 57 toward each other and parallel to the inner wall segment 51. Referring now to FIGS. 2 and 5, channel 61 defines a channel opening between the respective inlet duct side wall segments 57 and ledges 59 at opposite sides of inlet duct 43.

Referring again to FIGS. 2, 4, and 5, inlet duct 43 and channel 61 (FIGS. 2 and 5) are shown with a narrowing or width tapering configuration in which side wall segments 57 of inlet duct 43 extend angularly toward each other, from front wall 25 toward the intersection of inlet duct 43 and inverter module assembly duct 45. This provides a scoop-like configuration of inlet duct 43 that can collect a relatively large volume of air through intake opening 49 (FIGS. 1-3) and concentrate it into a relatively narrower airflow 9 (FIGS. 1 and 3) for initial cooling of the inverter module assembly 33. An inlet duct outer wall 63 also has a narrowing width dimension corresponding to that of the channel 61 and overall narrowing of the inlet duct 43. Inlet duct outer wall 63 is removably attached to the remainder of the inlet duct 43. As shown in FIGS. 2, 3, and 5, inlet duct outer wall 63 is defined by an upper wall of pocket 65, shown as upper pocket wall 67. Upper pocket wall 67 has a generally trapezoidal perimeter shape providing the width tapering corresponding to that of the inlet duct 43. Pocket 65 is recessed into an outwardly facing surface of the front wall 25, extending inwardly toward the housing open interior space 28. Lower pocket wall 69 has a shape generally corresponding to the perimeter shape of upper pocket wall 67, shown with a generally trapezoidal perimeter shape. Side pocket walls 71 are also shown with generally trapezoidal perimeter shapes extending between and connecting the upper and lower pocket walls 67, 69. Pocket back wall 73 interconnects the upper, lower, and side pocket walls 67, 69, 71 and is arranged generally perpendicular with respect to the bottom wall 13 of housing 11. An outwardly facing cavity bounded by the pocket 65 provides a space for holding bodies of various gauges, outlets, buttons, and/or other accessories with only their outer faces visible through the outer surface of the front wall 25 (FIG. 3) while the tapering configuration of pocket 65 allows the relevant portion(s) of pocket 65 recently received into the channel 61 so that the pocket upper wall 67 can define the inlet duct outer wall 63. It is understood that pocket 65 and its walls 67, 69, 71, 73 can have different perimeter shapes and configurations, based on the corresponding configuration of the overall configuration of the inlet duct 43, when the pocket 65 is configured to define a part of the inlet duct 43 to suitably seal the inlet duct 43 as an air collecting and conducting conduit.

Figure 6:
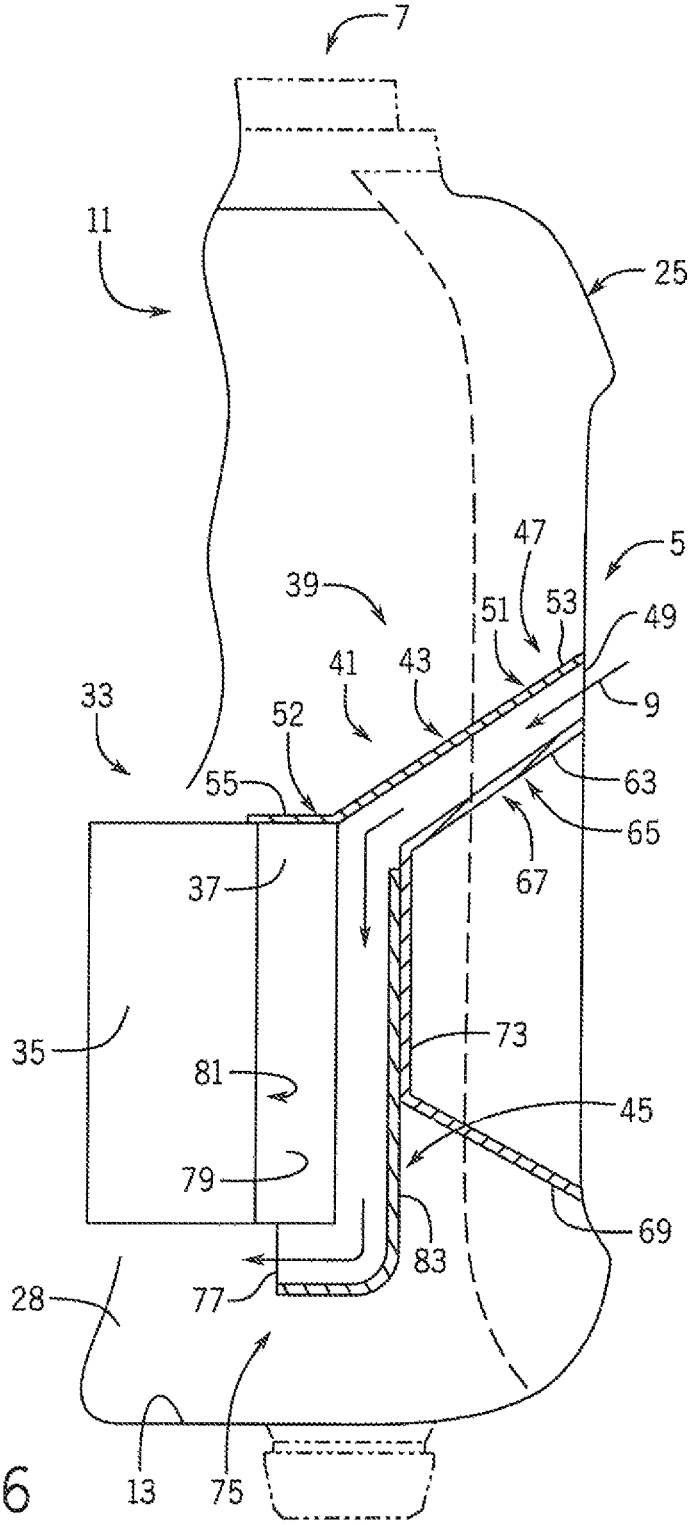
FIG. 6 is sectional view of a portion of the airflow system of FIG. 1.
Figure 7:
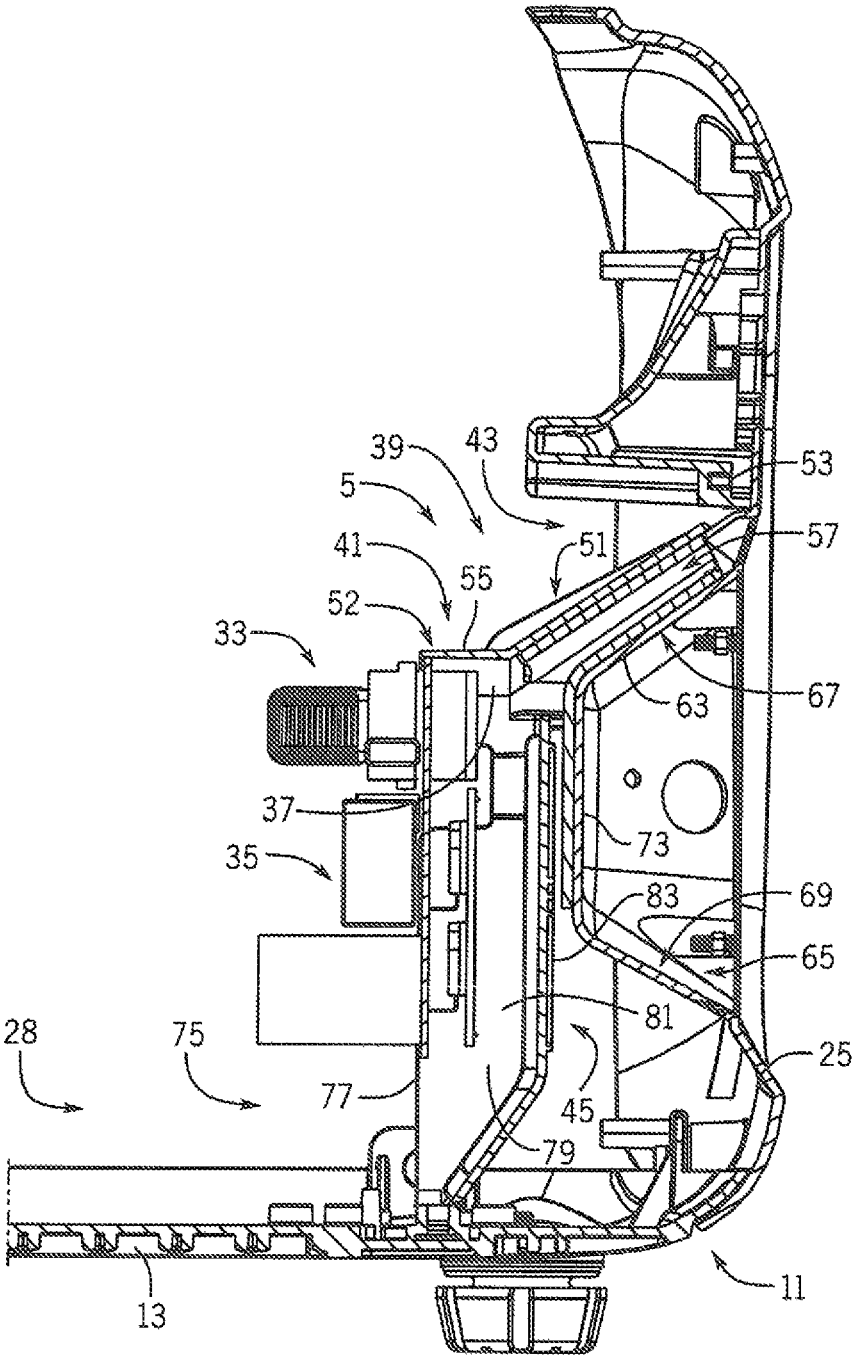
FIG. 7 is sectional view of a portion of the airflow system of FIG. 3.

Referring now to FIGS. 6 and 7, during use, when the front wall 25 is attached to the rest of the housing 11, the pocket back wall 73 is shown parallel to the inverter module assembly duct 45. FIG. 6 shows inverter module assembly duct 45 and pocket back wall 73 in face-to-face abutment with each other. FIG. 7 shows inverter module assembly duct 45 and pocket back wall 73 spaced from each other by a space that may be filled by an insulating or other material or acoustic treatment arrangements (not shown).

Referring again to FIGS. 2 and 3, inverter module assembly duct 45 of plenum body 41 is arranged at an outlet end 75 of plenum body 41, downstream of the intake end 47 with the inverter module assembly duct 45 angularly intersecting inlet duct 43 such that the inlet and inverter module assembly ducts 43, 45 are arranged at a non-perpendicular angle with respect to each other. Inverter module assembly duct 45 includes outlet opening 77 that corresponds to an intake plenum system point of exit delivering the intake airflow 9 (FIG. 1) out of the intake plenum system 39 substantially unrestricted into the open interior space 28 of housing 11. In this way, substantially all of the air in the open interior space 28 of housing 11 may enter housing 11 through intake plenum system 39.

Referring now to FIGS. 5-7, an outwardly facing surface(s) 79 of heatsink 37 defines inner wall segment 81 of inverter module assembly duct 45. Transversely spaced from and arranged generally parallel to wall segment 81 is outer wall segment 83 of Plenum body 41. Inverter module assembly duct side wall segments 85 extend from respective outer portions of outer wall segment 83 away from the front wall 25 and defining portions of the collar 52 engaging respective sides of the heatsink 37 and inverter module 35 (FIG. 4). In this way, the collar 52 includes the inverter module assembly duct side wall segments 85 overlapping at least a portion of the inverter module assembly 33. Thus the inverter module assembly 33 is at least partially nested within the inverter module assembly duct 45, with the inverter module assembly duct 45 fitting in a cap-like manner over a forward facing surface of the inverter heat sink 37 by way of the overlapping relationship of the inverter module assembly duct sidewall segments 85 with respect to the heatsink 37. Lower wall segment 87 extends between and interconnects the outer and side wall segments 83, 85. FIG. 6 shows lower wall segment 87 arranged generally parallel to the housing bottom wall 13 and downwardly facing surfaces of the inverter module 35 and heatsink 37, transitioning in a relatively smooth curve from the outer wall segment 83 to the lower wall segment 87. A lower edge of the lower wall segment 87 is shown spaced from the housing lower wall 13 in FIG. 6. Lower wall segment 87 shown in FIG. 7 is arranged generally angularly to the housing bottom wall 13 and downwardly facing surfaces of the inverter module 35 and heatsink 37, extending a different angle than inlet duct 43. FIG. 7 shows lower wall segment 87 transitioning in a relatively less curved or sharper angular transition from the outer wall segment 83 to the lower wall segment 87 compared to that of FIG. 6. A lower edge of the lower wall segment 87 is shown engaging the housing lower wall 13 in FIG. 7. The lower wall segment 87 may be configured with other angles or other geometries, including non-uniform configurations across its width, and/or incorporating vanes to force air exiting the plenum body 41 in certain locations as required to dissipate heat. Referring now to FIGS. 6 and 7, plenum body 41 is shown configured with the plenum body intake and outlet openings 49, 77 respectively arranged above and below and on different sides of an outer surface of the heat sink 73. Plenum body intake opening 49 is misaligned with respect to the inverter module assembly 33. Intake opening 49 is shown height staggered with respect to the inverter module assembly 33, higher than the inverter module assembly 33 relative to front wall 25 and thus spaced farther from housing bottom wall 13. Plenum body outlet opening 77 is arranged below the inverter module assembly 33, with the heatsink 37 transversely nested within the plenum body 41. The relative arrangements of the inverter module assembly 33, plenum body 41, and their respective components, allow for directing the intake airflow 9 (FIG. 6) along a flow path that flows over multiple surfaces of the inverter module assembly 33, such as longitudinally along and between the fins of heatsink 37 and across a downwardly facing surface(s) of the inverter module assembly 33. The width tapering configuration of the inlet duct 43 facilitates collecting and concentrating air of the intake airflow 9 (FIG. 6) before flowing across the inverter module assembly 33. The misalignment of the plenum body intake opening 49 with respect to the inverter module assembly 33 keeps the intake opening 49 out of line of sight transmission of sound, allowing the plenum body 41 and its components and other components of the generator 7 (FIG. 1) arranged between sound-generating components and the plenum body intake opening 49 to act as sound-damping baffles within the housing 11.

Many changes and modifications could be made to the invention without departing from the spirit thereof. The scope of these changes will become apparent from the appended claims.

We claim:

1. An airflow system for an enclosed portable generator having a housing with interconnected walls defining an open interior space therein enclosing an internal combustion engine providing torque converted to electrical power by the enclosed portable generator and a heat generating component producing heat during conversion of the engine provided torque into electrical power, the airflow system comprising:

an intake plenum system directing an intake airflow into the enclosure for cooling an inverter module assembly, the intake plenum system including a plenum body having, an intake end defining an intake opening corresponding to an intake plenum system point of entry receiving air through at least one of the interconnected walls of the enclosure into the intake plenum system as the intake airflow;

an outlet end arranged downstream of the intake end and including an outlet opening corresponding to an intake plenum system point of exit delivering the intake airflow out of the intake plenum system substantially unrestricted into the open interior space of the housing; and an inverter module assembly duct having an input communicating with the input end and an outlet defining the outlet end of the plenum body;

wherein:

the inverter module assembly has a first side isolated from the inverter module assembly duct and an opposite second side communicating with and partially defining the inverter module assembly duct; and a substantial entirety of the intake airflow passes through the inverter module assembly duct and over the second side of the inverter module assembly to cool the inverter module assembly.

2. The airflow system of claim 1 wherein the heat generating component is the inverter module assembly producing AC (alternating current) power and operably connected to an alternator driven by the engine provided torque.

3. The airflow system of claim 2 wherein the plenum body intake opening is misaligned with respect to the inverter module assembly.

4. The airflow system of claim 3 wherein the plenum body intake opening is arranged at the at least one of the interconnected walls of the housing at a position that is height staggered with respect to the inverter module assembly.

5. The airflow system of claim 4 wherein the interconnected walls of the housing includes a bottom wall and the plenum body intake opening is arranged relatively farther from the bottom wall of the housing than the inverter module assembly.

6. The airflow system of claim 2 wherein substantially all of the air in the open interior space of the housing enters the open interior space of the housing through the intake plenum system.

7. The airflow system of claim 2 wherein the plenum body includes:

an inlet duct defining the intake end of the plenum body and extending from the plenum body intake opening toward the inverter module assembly; and the inverter module assembly duct extending from the inlet duct toward the open interior space of the housing.

8. The airflow system of claim 7 wherein the inlet duct and the inverter module assembly duct are arranged at a non-perpendicular angle with respect to each other.

9. The airflow system of claim 8 wherein at least a portion of the inlet duct extends angularly with respect to the inverter module assembly.

10. The airflow system of claim 8 wherein at least a portion of the inverter module assembly duct extends parallel with respect to the inverter module assembly.

11. The airflow system of claim 10 wherein the inverter module assembly duct includes a first wall segment arranged substantially parallel to a first surface of the inverter module assembly and a second wall segment arranged substantially parallel to a second surface of the inverter module assembly.

12. The airflow system of claim 7 wherein the first side of the inverter module assembly faces toward the open interior space of the housing and the second side of the inverter module assembly faces away from the open interior space of the housing, and wherein the inverter module assembly duct covers the second side of the inverter module assembly and includes an outer wall segment transversely spaced from the second side of the inverter module assembly restricting flow of the intake airflow between the second side of the inverter module assembly and the outer wall segment of the inverter module assembly duct and to flow longitudinally with respect to the second side of the inverter module assembly.

13. The airflow system of claim 12 wherein the inverter module assembly duct includes side wall segments extending from the outer wall segment of the inverter module assembly duct toward and overlapping at least a portion of the inverter module assembly, wherein the inverter module assembly is at least partially nested within the inverter module assembly duct.

14. The airflow system of claim 7 wherein the interconnected walls of the housing includes a front wall, and the inlet duct includes an inlet duct inner wall segment connected to the inverter module assembly and an inlet duct outer wall segment connected to the housing front wall.

15. An airflow system for an enclosed portable generator having a housing with interconnected walls defining an open interior space therein enclosing an internal combustion engine providing torque converted to electrical power by the enclosed portable generator and a heat generating component producing heat during conversion of the engine provided torque into electrical power, the airflow system comprising:

an intake plenum system directing an intake airflow into the enclosure for cooling an inverter module assembly, the intake plenum system including a plenum body having, an intake end defining an intake opening corresponding to an intake plenum system point of entry receiving air through at least one of the interconnected walls of the enclosure into the intake plenum system as the intake airflow; and an outlet end arranged downstream of the intake end and including an outlet opening corresponding to an intake plenum system point of exit delivering the intake airflow out of the intake plenum s stem substantially unrestricted into the oven interior space of the housing;

wherein:

the heat generating component is the inverter module assembly producing AC (alternating current) power and operably connected to an alternator driven by the engine provided torque;

the plenum body includes:

an inlet duct defining the intake end of the plenum body and extending from the plenum body intake opening toward the inverter module assembly; and an inverter module assembly duct defining the outlet end of the plenum body and extending from the inlet duct toward the open interior space of the housing;

the interconnected walls of the housing includes a front wall, and the inlet duct includes an inlet duct inner wall segment connected to the inverter module assembly and an inlet duct outer wall segment connected to the housing front wall; and the inlet duct includes side wall segments extending from the inner wall segment collectively defining a channel with a channel opening between the inlet duct side wall segments, and wherein the inlet duct outer wall segment is removably received between the inlet duct side wall segments spanning across the channel opening when the housing front wall is removably connected to the remainder of the housing.

16. The airflow system of claim 15 wherein the housing front wall has an outwardly facing surface and includes a pocket recessed into the outwardly facing surface of the housing front wall toward the open interior space of the housing, and wherein at least a portion of the housing front wall pocket defines the inlet duct outer wall segment.

17. The airflow system of claim 16 wherein the housing front wall pocket includes a pocket upper wall extending angularly from a perimeter extending about an opening of the housing front wall pocket facing away from the open interior space of the housing, and wherein the pocket upper wall extends generally parallel to and spaced from the inlet duct inner wall segment.

18. The airflow system of claim 15 wherein the inlet duct side wall segments have outer ends relatively further from the open interior space of the housing and inner ends relatively closer to the open interior space of the housing, and wherein the inlet duct side wall segments extend angularly toward each other from the outer ends toward the inner ends reducing a width dimension of the channel from the outer ends toward the inner ends of the inlet duct side wall segments.

* * * * *